US008816607B2

(12) United States Patent
Chung et al.

(10) Patent No.: US 8,816,607 B2
(45) Date of Patent: Aug. 26, 2014

(54) LED EMITTING DEVICE AND DRIVING METHOD THEREOF

(75) Inventors: Jinhwa Chung, Seoul (KR); Byunghak Ahn, Seoul (KR); Moonho Choi, Bucheon (KR); Jaewoon Kim, Goyang (KR)

(73) Assignee: Fairchild Korea Semiconductor Ltd., Bucheon (KR)

( * ) Notice: Subject to any disclaimer, the term of this patent is extended or adjusted under 35 U.S.C. 154(b) by 169 days.

(21) Appl. No.: 13/354,115

(22) Filed: Jan. 19, 2012

(65) Prior Publication Data

US 2012/0201019 A1 Aug. 9, 2012

(30) Foreign Application Priority Data

Feb. 7, 2011 (KR) ..... 10-2011-0010699

(51) Int. Cl.

| | |
|---|---|
| ***H05B 37/02*** | (2006.01) |
| ***F21S 9/04*** | (2006.01) |
| ***H05B 33/08*** | (2006.01) |

(52) U.S. Cl.

CPC ..... *H05B 33/0815* (2013.01); *H05B 33/0818* (2013.01)

USPC ..... 315/307; 315/186; 362/184

(58) Field of Classification Search

CPC combination set(s) only.

See application file for complete search history.

(56) References Cited

U.S. PATENT DOCUMENTS

| | | | | |
|---|---|---|---|---|
| 7,888,887 | B2 * | 2/2011 | Utsuno et al. | 315/307 |
| 8,198,832 | B2 * | 6/2012 | Bai et al. | 315/307 |
| 8,334,662 | B2 * | 12/2012 | Jin et al. | 315/299 |
| 8,390,262 | B2 * | 3/2013 | Chang et al. | 323/282 |
| 8,598,803 | B2 * | 12/2013 | Kuo et al. | 315/291 |
| 2004/0251854 | A1 * | 12/2004 | Matsuda et al. | 315/291 |
| 2010/0308749 | A1 * | 12/2010 | Liu | 315/307 |
| 2010/0327758 | A1 * | 12/2010 | Chung et al. | 315/186 |
| 2012/0032611 | A1 * | 2/2012 | Chung et al. | 315/297 |
| 2012/0062136 | A1 * | 3/2012 | Tsai et al. | 315/224 |
| 2013/0293109 | A1 * | 11/2013 | CHEON et al. | 315/122 |

OTHER PUBLICATIONS

CAT4026 6-Channel LED Controller with Fault Diagnostics for Large Panel LED Backlighting, Nov. 2010—Rev.4, pp. 1-14, ON Semiconductor.

MAX17061 8-String White LED Driver with SMBus for LCD Panel Applications, Jan. 2008, pp. 1-26, Maxim Integrated Products.

* cited by examiner

*Primary Examiner* — Alexander H Taningco
*Assistant Examiner* — Nelson Correa
(74) *Attorney, Agent, or Firm* — Okamoto & Benedicto LLP

(57) ABSTRACT

The present invention relates to an LED light emitting device and a driving method thereof. The LED light emitting device supplies a power supply voltage to at least two LED channels. The LED light emitting device samples channel voltages of the at least two LED channels to detect a minimum voltage from among the sampled voltages, and amplifies a difference between the detected minimum voltage and a predetermined reference voltage to generate an error amplifying signal. The LED light emitting device generates an enable signal having a duty extended by a predetermined delay period from a duty of a dimming signal for controlling light emission periods of the at least two LED channels. In this instance, the error generator is operable by the enable signal.

20 Claims, 6 Drawing Sheets

LED EMITTING DEVICE AND DRIVING METHOD THEREOF

CROSS-REFERENCE TO RELATED APPLICATION

This application claims priority to and the benefit of Korean Patent Application No. 10-2011-0010699 filed in the Korean Intellectual Property Office on Feb. 7, 2011, the entire contents of which are incorporated herein by reference.

BACKGROUND (a) Field

Embodiments of the present invention relate to an LED light emitting device and a driving method thereof. More particularly, embodiments relate to an LED light emitting device for controlling a power supply voltage supplied to an LED channel, and a driving method thereof.

(b) Description of the Related Art

An LED light emitting device drives an LED by supplying a current to the LED. The LED emits light with brightness that corresponds to the current. The LED light emitting device emits light with predetermined brightness by controlling a predetermined current to flow to an LED channel configured with a plurality of LEDs coupled in series. An operation for supplying a current to the LED channel and emitting it is called a turn-on operation, and an operation for intercepting supply of current to the LED channel and thereby stopping emission of light is called a turn-off operation.

The LED light emitting device includes a plurality of LED channels, and controls the current flowing to the LED channels. A plurality of LED channels are coupled in parallel, and the power supply voltages applied to the respective LED channels are the same.

When the period in which the LED channel is turned on is short, the operational time of the power supply for generating a power supply voltage is reduced. The power supply voltage is reduced so the power supply voltage is reduced to be less than a voltage level for driving the LED channel. When the power supply voltage is reduced, the LED channel may not be operated or the current supplied to the LED channel is reduced to decrease the light of the LED channel.

The above information disclosed in this Background section is only for enhancement of understanding of the background of the invention and therefore it may contain information that does not form the prior art that is already known in this country to a person of ordinary skill in the art.

SUMMARY

Embodiments of the present invention have been made in an effort to provide an LED light emitting device for supplying a power supply voltage in a secure manner, and a driving method thereof.

An exemplary embodiment of the present invention provides an LED light emitting device including at least two LED channels including: a power supply for supplying a power supply voltage to first ends of the at least two LED channels; an error generator for sampling channel voltages of the at least two LED channels to detect a minimum voltage from among the sampled voltages and amplifying a difference between the detected minimum voltage and a predetermined reference voltage to generate an error amplifying signal; and a delay circuit for generating an enable signal having a duty extended by a predetermined delay period from a duty of a dimming signal for controlling light emission periods of the at least two LED channels.

The error generator is operable by the enable signal.

The error generator includes an error amplifier operable by the enable signal, receiving the reference voltage and the minimum voltage, and amplifying a difference of the reference voltage and the minimum voltage by a predetermined gain to generate the error amplifying signal.

The error generator further includes a buffer operable by the enable signal and outputting a feedback signal following the error amplifying signal.

The power supply includes: a transformer including a primary coil for receiving an input voltage and a secondary coil for generating an output voltage;

a power switch connected to the primary coil and controlling power transmitted to the secondary coil from the primary coil; and a switch control circuit for receiving the feedback signal according to the enable signal, and controlling a switching operation of the power switch according to a result of comparing the feedback signal and a current flowing to the power switch.

The switch control circuit includes: a feedback signal transmitter for generating a feedback voltage through a photocoupler for receiving the feedback signal according to the enable signal; and a PWM controller for determining a turn-off time of the power switch by comparing a voltage that corresponds to the feedback voltage and a voltage that corresponds to a current flowing to the power switch, and turning on the power switch according to a clock signal for determining a switching frequency of the power switch.

The PWM controller stops the switching operation of the power switch by using a result of comparing the feedback voltage and a predetermined burst reference voltage.

The feedback signal transmitter includes: a photodiode of the photocoupler including a cathode for receiving the feedback signal; a control switch connected between the cathode and a ground and performing a switching operation according to the enable signal; a phototransistor of the photocoupler; a capacitor connected in parallel to the phototransistor; and a current source for supplying a feedback current to the capacitor and the phototransistor.

The delay circuit includes: an SR flip-flop for starting an operation in synchronization with a duty begin time of the dimming signal, and generating a first pulse that ends at a time delayed by the delay period from a duty finish time of the dimming signal; and an inverter for generating the enable signal by inverting the first pulse.

The delay circuit further includes: an AND gate for generating a second pulse in synchronization with the time when the dimming signal is finished; and a delay pulse generator for generating a third pulse at a time that is delayed by the delay period from the time when the second pulse is generated.

The SR flip-flop includes: a first NOR gate for receiving the dimming signal; and a second NOR gate for receiving the third pulse, wherein an output of the second NOR gate is further input to the first NOR gate, an output of the first NOR gate is further input to the second NOR gate, the first pulse is an output of the first NOR gate, and an output of the second NOR gate is further input to the logic gate.

Another embodiment of the present invention provides an LED light emitting device including at least two LED channels, including: a power supply for supplying a power supply voltage to first ends of the at least two LED channels; an error generator for sampling channel voltages of the at least two LED channels to detect a minimum voltage from among sampled voltages and amplifying a difference between the detected minimum voltage and a predetermined reference voltage to generate an error amplifying signal; and a delay circuit for generating an enable signal having a predetermined threshold duty when a duty of a dimming signal for controlling light emission periods of the at least two LED channels is shorter than the threshold duty, and the error generator is operable by the enable signal.

The error generator includes an error amplifier operable by the enable signal, receiving the reference voltage and the minimum voltage, and amplifying a difference of the reference voltage and the minimum voltage by a predetermined gain to generate the error amplifying signal.

The error generator further includes a buffer operable by the enable signal and outputting a feedback signal following the error amplifying signal.

The power supply includes: a transformer including a primary coil for receiving an input voltage and a secondary coil for generating an output voltage; a power switch connected to the primary coil and controlling power transmitted to the secondary coil from the primary coil; and a switch control circuit for receiving the feedback signal according to the enable signal, and controlling a switching operation of the power switch according to a result of comparing the feedback signal and a current flowing to the power switch.

The delay circuit includes: a minimum pulse generator for generating a pulse having the threshold duty in synchronization with a duty begin time of the dimming signal; and a logical operator for performing an AND operation on the dimming signal and the pulse.

Another embodiment of the present invention provides a method for driving an LED light emitting device including a power switch performing a switching operation to supply a power supply voltage to the LED light emitting device including at least two LED channels, including: sampling channel voltages of the at least two LED channels to detect a minimum voltage from among the sampled voltages, and amplifying a difference between the detected minimum voltage and a predetermined reference voltage to generate an error amplifying signal; and generating an enable signal having a duty that is extended by a predetermined delay period from a duty of a dimming signal for controlling light emission periods of the at least two LED channels.

The generating of an error amplifying signal is performed while the enable signal is generated.

The generating of an enable signal includes: generating a first pulse that starts in synchronization with the duty begin time of the dimming signal, and ends by a time that is delayed by the delay period from a duty end time of the dimming signal; and generating the enable signal by inverting the first pulse.

The method further includes: outputting a feedback signal caused by the error amplifying signal according to the enable signal; and receiving the feedback signal according to the enable signal, and controlling a switching operation of the power switch according to a result of comparing the feedback signal and a current flowing to the power switch.

Another embodiment of the present invention provides a method for driving an LED light emitting device including a power switch performing a switching operation to supply a power supply voltage to the LED light emitting device including at least two LED channels, including: sampling channel voltages of the at least two LED channels to detect a minimum voltage from among the sampled voltages, and amplifying a difference between the detected minimum voltage and a predetermined reference voltage to generate an error amplifying signal; and generating an enable signal having a predetermined threshold duty when a duty of a dimming signal for controlling light emission periods of the at least two LED channels is shorter than the threshold duty.

The generating of an error amplifying signal is performed while the enable signal is generated.

The generating of an enable signal includes: generating a pulse having the threshold duty in synchronization with a duty begin time of the dimming signal; and generating the enable signal by performing an AND operation on the dimming signal and the pulse.

The method further includes: outputting a feedback signal following the error amplifying signal according to the enable signal; and receiving the feedback signal according to the enable signal, and controlling a switching operation of the power switch according to a result of comparing the feedback signal and a current flowing to the power switch.

The present invention provides an LED light emitting device for supplying the power supply voltage in a secure manner, and a driving method thereof.

DETAILED DESCRIPTION OF THE EMBODIMENTS

Figure 1:
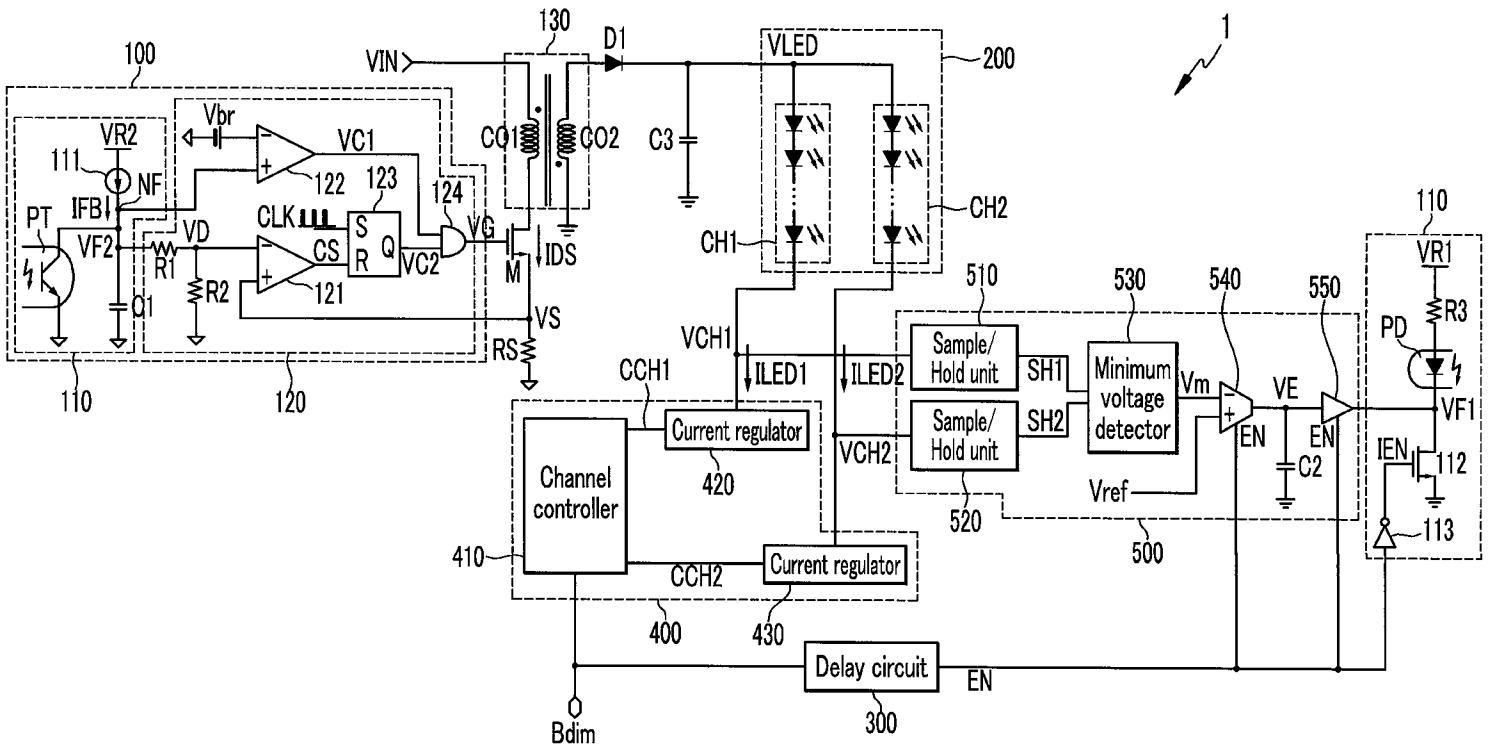
FIG. 1 shows an LED light emitting device according to an exemplary embodiment of the present invention.

In the following detailed description, only certain exemplary embodiments of the present invention have been shown and described, simply by way of illustration. As those skilled in the art would realize, the described embodiments may be modified in various different ways, all without departing from the spirit or scope of the present invention. Accordingly, the drawings and description are to be regarded as illustrative in nature and not restrictive. Like reference numerals designate like elements throughout the specification.

Throughout this specification and the claims that follow, when it is described that an element is "coupled" to another element, the element may be "directly coupled" to the other element or "electrically coupled" to the other element through a third element. In addition, unless explicitly described to the contrary, the word "comprise" and variations such as "comprises" or "comprising" will be understood to imply the inclusion of stated elements but not the exclusion of any other elements.

Embodiments of the present invention will be described more fully hereinafter with reference to the accompanying drawings, in which exemplary embodiments of the invention are shown.

FIG. 1 shows an LED light emitting device according to an exemplary embodiment of the present invention.

As shown in FIG. 1, the LED light emitting device 1 includes a switch control circuit 100, an LED light emitter 200 including LED channels CH1 and CH2, a delay circuit 300, a channel driver 400, and an error generator 500.

The LED light emitting device according to the exemplary embodiment of the present invention is shown to include LED channels, but the present invention is not limited thereto. That is, the LED light emitting device includes at least two LED channels. A number of current regulators and sample/hold units is determined by a number of a plurality of LED channels. Therefore, when the number of the LED channels is n, the number of the current regulators and the sample/hold units is n.

The LED channels CH1 and CH2 are configured with a plurality of LEDs, respectively. The LEDs included in the LED channels CH1 and CH2 are connected in series, respectively, and voltages at ends of the LED channels CH1 and CH2 are channel voltages VCH1 and VCH2. A power supply voltage (VLED) is applied to the LED channels CH1 and CH2, respectively.

The voltage at the LED channel CH1 is the power supply voltage (VLED) minus the channel voltage VCH1, and the voltage at the LED channel CH2 is the power supply voltage (VLED) minus the channel voltage VCH2.

The channel driver 400 includes current regulators 420 and 430 and a channel controller 410.

The channel controller 410 generates a channel control signal CCH1 and a channel control signal CCH2 for controlling the current regulator 420 and the current regulator 430 according to the dimming signal (Bdim). The dimming signal (Bdim) has a high level during a turn-on period for supplying a constant current to the LED channels CH1 and CH2, and has a low level during a turn-off period of the LED channels CH1 and CH2. However, the present invention is not limited thereto.

The channel controller 410 generates high-level channel control signals CCH1 and CCH2 and transmits them to the current regulator 420 and the current regulator 430 while the dimming signal (Bdim) is high. The channel controller 410 generates low-level channel control signals CCH1 and CCH2 and transmits them to the current regulator 420 and the current regulator 430 while the dimming signal (Bdim) is low.

The current regulator 420 is connected to an end of the LED channel CH1, and controls a constant drive current to flow to the LED channel CH1 according to the channel control signal CCH1.

The current regulator 430 is connected to an end of the LED channel CH2, and controls a constant drive current to flow to the LED channel CH2 according to the channel control signal CCH2.

The error generator 500 is controlled by the dimming signal (Bdim), samples the channel voltages VCH1 and VCH2 of the LED channels CH1 and CH2, detects a minimum voltage from among the sampled voltages, and amplifies a difference between the minimum voltage and a reference voltage (Vref) to generate an error signal (VE).

The error generator 500 includes sample/hold units 510 and 520, a minimum voltage detector 530, an error amplifier 540, a capacitor C2, and a buffer 550.

The sample/hold unit 510 samples the channel voltage VCH1 and holds the sampled voltage SH1 (hereinafter, the first sampling voltage). The sample/hold unit 520 samples the channel voltage VCH2, and holds the sampled voltage SH2 (hereinafter, the second sampling voltage).

The minimum voltage detector 530 detects a smaller voltage from among the first and second sampling voltages SH1 and SH2 transmitted by the sample/hold units 510 and 520 and generates the minimum voltage (Vmin).

The error amplifier 540 is operable by an enable signal (EN) transmitted by the delay circuit 300, and while operable by the enable signal (EN), it compares a predetermined reference voltage (Vref) and the minimum voltage (Vmin) to generate an error amplifying signal (VE). A capacitor C2 is connected to an output end of the error amplifier 540 to compensate a frequency gain of the error amplifying signal (VE). The error amplifying signal (VE) indicates feedback information for controlling the power supply voltage (VLED).

The error amplifier 540 includes an inverting terminal (−) for receiving the minimum voltage (Vmin) and a non-inverting terminal (+) for receiving the reference voltage (Vref), and it generates the error amplifying signal (VE) by amplifying the reference voltage (Vref) minus the minimum voltage (Vmin) by a predetermined gain.

The buffer 550 is operable by the enable signal (EN), and while operable by the enable signal (EN), it outputs the feedback signal VF1 caused by the error amplifying signal (VE) to the feedback signal transmitter 110.

The delay circuit 300 generates an enable signal (EN) in which the dimming signal (Bdim) has a duty extended by a predetermined delay period.

The power supply voltage (VLED) may be reduced because of the short duty of the dimming signal (Bdim) in the method in which the power switch (M) is switched during the duty period of the dimming signal (Bdim). The minimum voltage for driving the LED channels CH1 and CH2 with a constant current is called a normal voltage. When the power supply voltage (VLED) is reduced to be less than the normal voltage, the channel currents (ILED1, ILED2) may not flow to the LED channels CH1 and CH2.

For example, when the duty of the dimming signal (Bdim) is very short such as less than 1%, the switching period of the power switch (M) is reduced depending on the duty of the dimming signal (Bdim). In this instance, in the initial period of the duty of the dimming signal (Bdim), a period in which the feedback voltage VF2 rises to be a level that corresponds to the feedback signal VF1 occurs. During the rising period, the power switch (M) may not be switched because the feedback voltage VF2 is small.

When the duty of the dimming signal (Bdim) is short, a ratio of the rising period of the feedback voltage VF2 versus the duty of the dimming signal (Bdim) is not small, the power switch (M) is not sufficiently switched, and the power supply voltage (VLED) is reduced. The delay period can be set to be a period for compensating the rising period of the feedback voltage VF2.

The delay circuit 300 generates the enable signal by increasing the duty of the dimming signal (Bdim) by the delay period, so the power supply voltage (VLED) is reduced by the short duty of the dimming signal (Bdim) thereby preventing channel currents (ILED1, ILED2) from flowing to the LED channels CH1 and CH2.

The operational period of the error amplifier 540 and buffer 550 are extend by the delay period so the period in which the power switch (M) is not switched from among the rising period of the feedback signal VF2 is compensated.

A detailed configuration of the delay circuit 300 will be described later with reference to FIG. 2.

The LED light emitting device includes a power supply for supplying a power supply voltage (VLED). The power supply includes a power switch (M), a transformer 130, a switch control circuit 100, a sense resistor (RS), a rectifying diode D1, and a capacitor C3.

The transformer 130 includes a primary coil CO1 and a secondary coil CO2, and an input voltage (VIN) input to the primary coil CO1 is transmitted to the secondary coil CO2 according to the switching operation of the power switch (M). In this instance, a ratio between the input voltage (VIN) and a voltage at the secondary coil CO2 depends on the turn ratio of the primary coil CO1 versus the secondary coil CO2.

The power switch (M) is connected to the primary coil CO1 of the transformer 130, and controls the power transmitted to the secondary coil from the primary coil. While the power switch (M) is turned on, the current flows to the primary coil CO1 to charge power in the primary coil CO1. While the power switch (M) is turned off, the power charged in the primary coil CO1 is transmitted to the secondary coil CO2. The current flowing to the secondary coil CO2 is rectified by the rectifying diode D1 and is supplied to the LED light emitter 200. The capacitor C3 is charged by the current transmitted by the rectifying diode D1, and reduces a ripple component of the power supply voltage (VLED).

The power switch (M) is realized with an n-channel type of metal-oxide semiconductor field effective transistor (MOSFET), and the present invention is not limited thereto.

The sense resistor (RS) is connected between the power switch (M) and the ground, and a sense voltage VS occurs when the current flowing to the power switch (M) flows to the sense resistor (RS).

The switch control circuit 100 receives a feedback signal VF1 according to the enable signal (EN), and controls the switching operation of the power switch (M) according to the feedback signal VF1. The switch control circuit 100 includes a feedback signal transmitter 110 and a PWM controller 120.

The feedback signal transmitter 110 transmits the feedback signal VF1 generated by the secondary coil to the primary coil that is isolated from the secondary coil. The feedback signal transmitter 110 includes a photodiode (PD) and a phototransistor (PT) configuring a photocoupler, a resistor R3, a capacitor C1, a current source 111, a control switch 112, and an inverter 113.

The resistor R3 includes a first end for receiving a voltage VR1 and a second end connected to an anode of the photodiode (PD). The voltage VR1 is used for the operation of the photodiode (PD).

The feedback signal VF1 is transmitted to a cathode of the photodiode (PD), and the cathode is connected to the control switch 112. The inverter 113 inverts the enable signal (EN) to generate an inverted enable signal (IEN).

The feedback signal transmitter 110 is operated by the enable signal (EN). That is, when the enable signal (EN) is low, the control switch 112 is turned on by the inverted enable signal (IEN) and the feedback signal VF1 becomes a ground voltage. That is, the feedback signal transmitter 110 is not operated.

When the enable signal (EN) is high, the control switch 112 is turned off by the inverted enable signal (IEN), and the feedback signal VF1 is transmitted to the primary coil according to the current flowing to the photodiode (PD).

The current source 111 supplies a feedback current (IFB) by a voltage VR2, and the capacitor C1 and the port transistor (PT) are connected in parallel to the node (NF). The voltage at the node (NF) represents the feedback signal VF1 transmitted to the primary coil, and it will be called a feedback voltage VF2 hereinafter.

The feedback signal VF1 indicates a signal generated by amplifying a difference between the minimum voltage (Vmin) and the reference voltage (Vref), and when the difference between the two voltages is increased, the feedback signal VF1 is increased, and when the difference therebetween is reduced, the feedback signal VF1 is reduced.

As the feedback signal VF1 is increased, the voltage difference at the photodiode (PD) is reduced and the current flowing to the photodiode (PD) is reduced. When the current flowing to the photodiode (PD) is reduced, the current occurring at the phototransistor (PT) is reduced. The current supplied to the capacitor C1 from among the feedback current (IFB) is increased and the feedback voltage VF2 is increased. When the power supply voltage (VLED) is reduced so the channel voltage VCH1 or the channel voltage VCH2 is reduced, the minimum voltage (Vmin) is also reduced. A difference between the reference voltage (Vref) and the minimum voltage (Vmin) is increased so the feedback signal VF1 is increased.

Therefore, when the power supply voltage (VLED) is reduced, the feedback signal VF1 is increased and the feedback voltage VF2 is increased. The switch control circuit 100 increases the duty of the power switch (M) when the feedback voltage VF2 is increased.

When the feedback signal VF1 is reduced, the voltage difference at the photodiode (PD) is increased and the current flowing to the photodiode (PD) is increased. When the current flowing to the photodiode (PD) is increased, the current generated at the phototransistor (PT) is increased. The current supplied to the capacitor C1 from among the feedback current (IFB) is reduced and the feedback voltage VF2 is reduced. When the power supply voltage (VLED) is increased so the channel voltage VCH1 or the channel voltage VCH2 is increased, the minimum voltage (Vmin) is also increased. The difference between the reference voltage (Vref) and the minimum voltage (Vmin) is reduced and the feedback signal VF1 is reduced.

Accordingly, when the power supply voltage (VLED) is increased, the feedback signal VF1 is reduced and the feedback voltage VF2 is reduced. The switch control circuit 100 reduces the duty of the power switch (M) when the feedback voltage VF2 is reduced.

The PWM controller 120 receives the feedback voltage VF2, stops the switching operation of the power switch (M) while the feedback voltage VF2 does not occur, turns on the power switch (M) according to clock signals CLK for determining the switching period of the power switch (M), and turns off the power switch (M) according to the result of comparing the feedback voltage (VD) and the sense voltage VS.

The PWM controller 120 includes a PWM comparator 121, a burst comparator 122, an SR latch 123, a gate logical operator 124, and dividing resistors R1 and R2.

The feedback voltage VF2 is divided by a resistance ratio of the dividing resistor R1 versus the dividing resistor R2 to generate a dividing feedback voltage (VD). A resistance ratio of the dividing resistor R1 versus the dividing resistor R2 is set so as to change the feedback voltage VF2 to satisfy the operating voltage range of the PWM comparator 121.

The PWM comparator 121 compares the dividing feedback voltage (VD) corresponding to the feedback voltage VF2 and the sense voltage VS, and outputs a comparing signal (CS) for determining a turn-off time of the power switch (M). The PWM comparator 121 includes an inverting terminal (−) for receiving the dividing feedback voltage (VD) and a non-inverting terminal (+) for receiving the sense voltage VS, and the comparing signal (CS) is input to the reset terminal (R) of the SR latch 123.

The PWM comparator 121 outputs a high-level comparing signal (CS) when the input of the non-inverting terminal (+) is greater than the input of the inverting terminal (−), and it outputs a low-level comparing signal (CS) in another case. While the power switch (M) is turned off, the sense voltage VS is not generated and the PWM comparator 121 outputs a low-level comparing signal (CS). When the drain current (IDS) is increased and the sense voltage VS reaches the dividing feedback voltage (VD) while the power switch (M) is turned on, the PWM comparator 121 outputs a high-level comparing signal (CS).

The burst comparator 122 stops the operation of the power switch (M) according to the result of the feedback voltage VF2 and a predetermined burst reference voltage (Vbr). The burst comparator 122 includes a non-inverting terminal (+) for receiving the feedback voltage VF2 and an inverting terminal (−) for receiving the burst reference voltage (Vbr). The burst comparator 122 outputs a high-level signal when the input of the non-inverting terminal (+) is greater than the input of the inverting terminal (−), and it outputs a low-level signal in another case.

Therefore, the burst comparator 122 generates a high-level gate control signal VC1 when the feedback voltage VF2 is greater than the burst reference voltage (Vbr), and it generates a low-level gate control signal VC1 when the feedback voltage VF2 is less than the burst reference voltage (Vbr).

The SR latch 123 receives the clock signal CLK and the comparing signal (CS), turns on the power switch (M) for each period of the clock signal CLK, and generates a gate control signal VC2 for turning off the power switch (M) when the comparing signal (CS) rises.

The SR latch 123 includes a set terminal (S) for receiving the clock signal CLK, a reset terminal (R) for receiving an output signal of the PWM comparator 121, and an output terminal (Q) for outputting a gate control signal VC2 according to a logical operation of the clock signal CLK and the comparing signal (CS).

The SR latch 123 generates a high-level signal according to a rising edge of a signal input to the set terminal (S), and generates a low-level signal according to a rising edge of a signal input to the reset terminal (R). Therefore, the SR latch 123 generates a high-level gate control signal VC2 for turning on the power switch (M) in synchronization with the rising edge of the clock signal CLK, and generates a low-level gate control signal VC2 for turning off the power switch (M) in synchronization with the rising edge of the comparing signal (CS).

The gate logical operator 124 generates a gate signal (VG) according to the gate control signals VC1 and VC2. The gate logical operator 124 represents an AND gate.

While the low-level gate control signal VC1 is input to the gate logical operator 124, the gate signal (VG) is low and the power switch (M) is maintained in the turn-off state.

While the high-level gate control signal VC1 is input to the gate logical operator 124, the gate signal (VG) is generated according to the gate control signal VC2. That is, the gate logical operator 124 generates a high-level gate signal (VG) according to the high-level gate control signal VC2, and generates a low-level gate signal (VG) according to the low-level gate control signal VC2.

A configuration and an operation of a delay circuit 300 will now be described with reference to FIG. 2 and FIG. 3.

Figure 2:
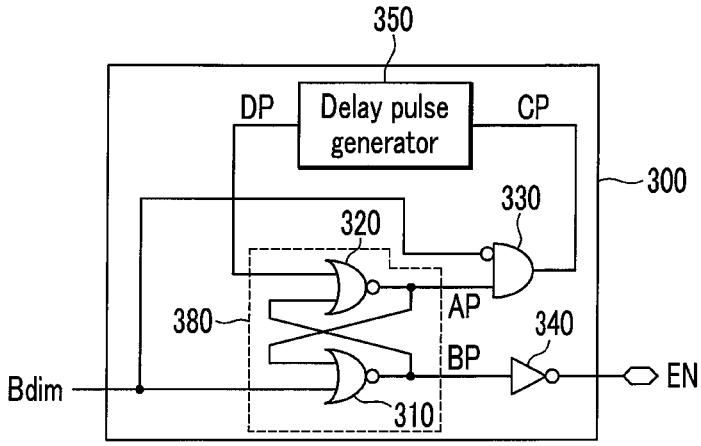
FIG. 2 shows a configuration of a delay circuit according to an exemplary embodiment of the present invention.

FIG. 2 shows a configuration of a delay circuit according to an exemplary embodiment of the present invention.

As shown in FIG. 2, the delay circuit 300 includes a first NOR gate 310, a second NOR gate 320, an AND gate 330, an inverter 340, and a delay pulse generator 350. Respective input and output ends of the first NOR gate 310 and the second NOR gate 320 are alternately connected to form an SR flip-flop 380.

An input end of the first NOR gate 310 is a set terminal of the SR flip-flop 380, an input end of the second NOR gate 320 is a reset terminal of the SR flip-flop 380, an output end of the first NOR gate 310 is an inverting output end of the SR flip-flop 380, and an output end of the second NOR gate 320 is an output end of the SR flip-flop 380. The SR flip-flop is shown to be realized with a NOR gate in the exemplary embodiment of the present invention, but the present invention is not limited thereto. When the respective levels of the input signal and the output signal of the SR flip-flop are changed depending on the design, it can be realized with a different logic gate.

The first NOR gate 310 generates a pulse (BP) by inverting an OR operation of the dimming signal (Bdim) and the output of the second NOR gate 320. The second NOR gate 320 generates a pulse (AP) by inverting an OR operation of the output of the delay pulse generator 350 and the output of the first NOR gate 310.

The pulse (BP) begins in synchronization with the rising edge of the dimming signal (Bdim), and it ends in synchronization with the rising edge of the pulse (DP). The pulse (BP) according to the exemplary embodiment of the present invention is a low-level pulse. The enable signal (EN) is the inverted pulse (BP) so the enable signal (EN) is generated in synchronization with the rising edge of the dimming signal (Bdim) and it is finished in synchronization with the rising edge of the pulse (DP).

The AND gate 330 performs an AND operation on the inverted dimming signal (Bdim) and the second NOR gate output to generate a pulse (CP).

The delay pulse generator 350 generates a delay pulse (DP) after a predetermined delay period from the time when the pulse (CP) is generated.

An operation of a delay circuit 300 will now be described with reference to FIG. 3.

Figure 3:
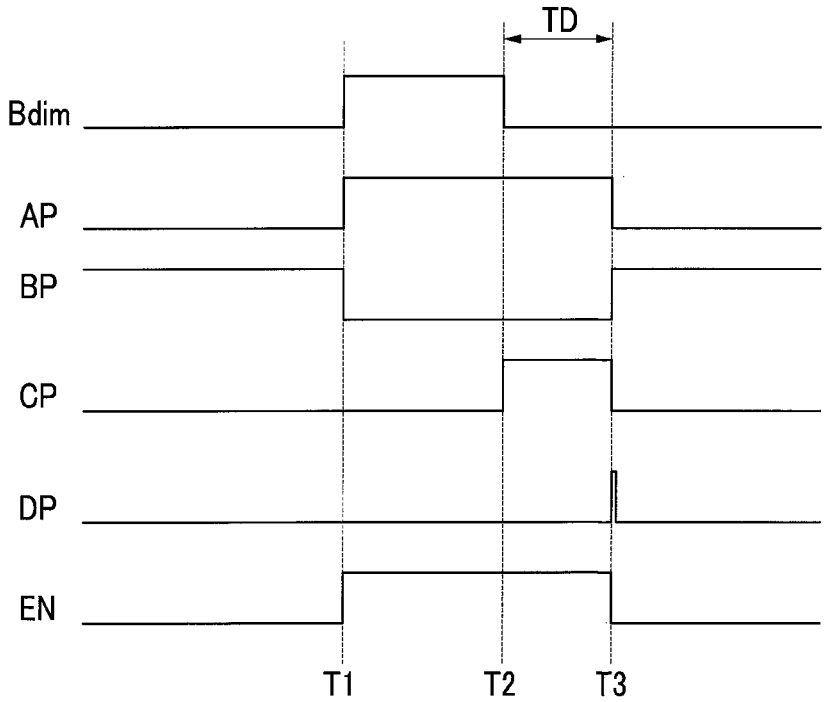
FIG. 3 shows pulses, a dimming signal, and an enable signal generated by a delay circuit.

FIG. 3 shows pulses, a dimming signal, and an enable signal generated by a delay circuit.

The pulse (BP) begins at the rising time T1 of the dimming signal (Bdim). The inverter 340 inverts the pulse (BP) to generate the enable signal (EN) at the time T1. When the inputs of the second NOR gate 320 are low, the pulse (AP) occurs at the time T1.

The inputs of the AND gate 330 become high at the falling time T2 of the dimming signal (Bdim) so the AND gate 330 generates a pulse (CP).

The delay pulse generator 350 generates a delay pulse (DP) at the time T3 having passed the delay period (TD) from the time T2. The delay pulse (DP) is input to the second NOR gate 320 so the pulse (AP) is finished by the delay pulse (DP) at the time T3. At the time T3 when the pulse (AP) is finished, the pulse (BP) is finished becoming high. The pulse (BP) is inverted by the inverter 340 so the enable signal (EN) becomes low and is finished.

Accordingly, when the signal (Bdim) becomes high, the input of the inverter 340 becomes low to generate an enable signal (EN), and when the pulse (DP) input to the second logic gate 320 becomes high, that is, from the time delayed by the delay period from the falling time of the dimming signal (Bdim), the input of the inverter 340 becomes high to finish the enable signal (EN).

That is, the enable signal (En) having the duty generated by adding the delay period to the duty of the dimming signal (Bdim) is generated.

An operation of an error generator and a switch control circuit will now be described with reference to FIG. 4.

Figure 4:
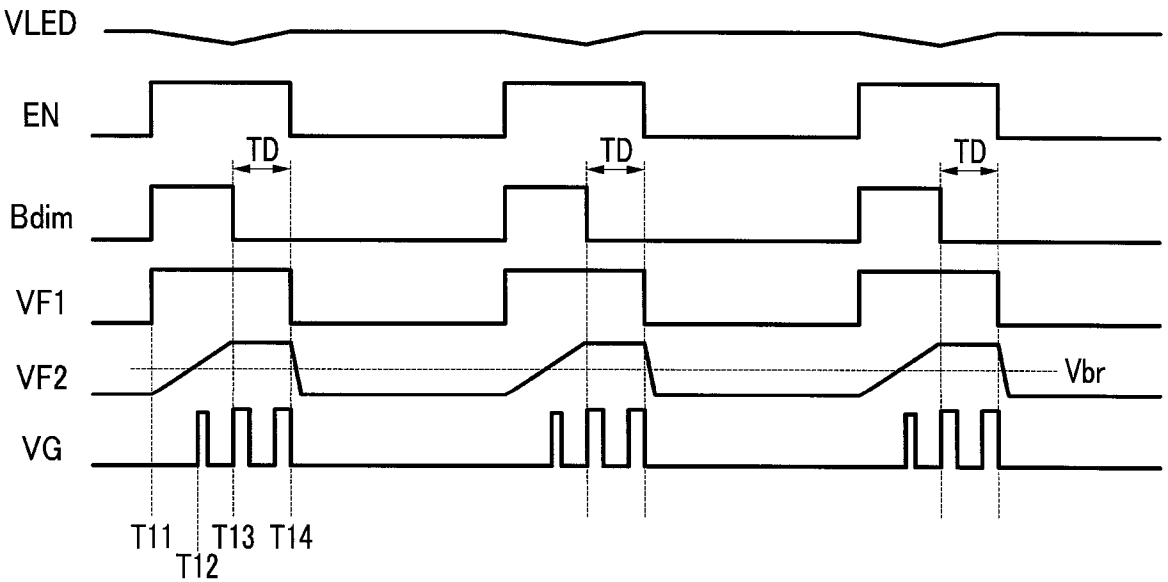
FIG. 4 shows a power supply voltage, an enable signal, a dimming signal, a feedback signal, a feedback voltage, and a gate voltage according to an exemplary embodiment of the present invention.

FIG. 4 shows a power supply voltage, an enable signal, a dimming signal, a feedback signal, a feedback voltage, and a gate voltage according to an exemplary embodiment of the present invention.

At the time T11, the dimming signal (Bdim) rises to the high-level, and the enable signal (En) is generated. In the exemplary embodiment of the present invention, the enable signal (En) is high-level so the enable signal (En) rises to the high level and the error amplifier 540 and the buffer 550 are operated by the enable signal (En) at the time T11.

At the time T11, the feedback signal VF1 is generated and the feedback voltage VF2 begins to rise. Before the time T12, the feedback voltage VF2 is less than the burst reference voltage (Vbr) and no gate signal (VG) is generated. Starting from the time T12, the gate signal (VG) rises in synchronization with the rising edge of the clock signal CLK, and when the sense voltage VS reaches the dividing feedback voltage (VD), the gate signal (VG) falls.

The dimming signal (Bdim) falls to the low-level at the time T13, and the delay circuit 300 maintains the enable signal (En) by the delay period (DT) starting from the time T13 so the error amplifier 540 and the buffer 550 maintain their operation. The enable signal (En) is extended by the delay period (TD) so the gate signal (VG) is generated during the delay period (TD). Hence, the switching period of the power switch (VG) is extended so the power supply voltage (VLED) is reduced and is increased again to maintain a constant voltage.

When the delay period (TD) is finished at the time T14, the enable signal (EN) is finished and the error amplifier 540 and the buffer 550 are not operated. Therefore, the feedback signal VF1 falls to the low level and the feedback voltage VF2 begins to fall. After the time T14, the feedback voltage VF2 becomes less than the burst reference voltage (Vbr) so the gate signal (VG) is maintain at the low level.

The above-described operation is repeated during two other periods of the dimming signal (Bdim) shown in FIG. 4. As shown in FIG. 4, when the feedback voltage VF2 is less than the burst reference voltage (Vbr), the power switch (M) is not switched and the power supply voltage (VLED) is reduced, and during the delay period (TD), the power supply voltage (VLED) rises to be maintained by the switching operation of the power switch (M).

Figure 5:
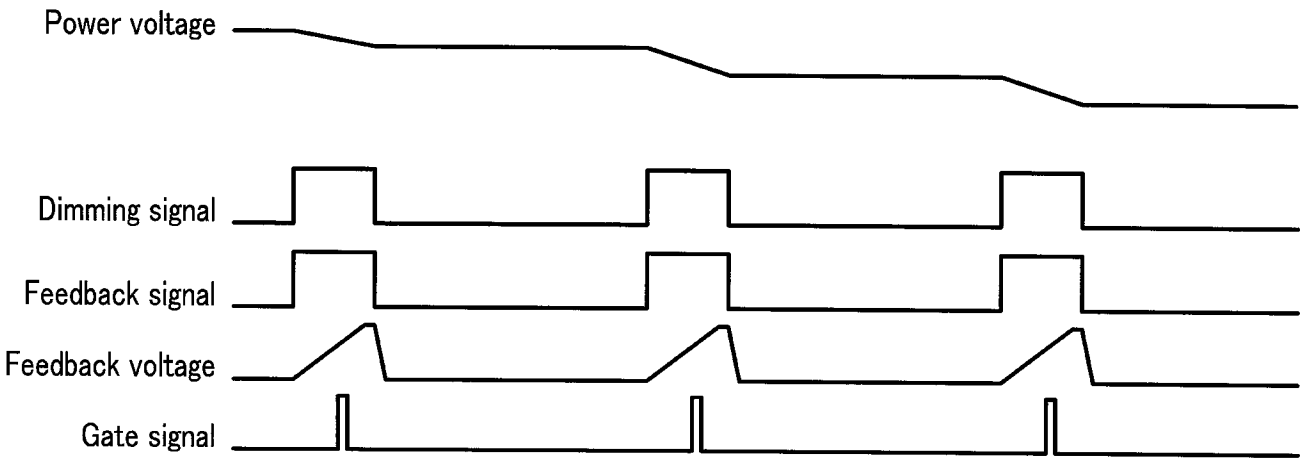
FIG. 5 shows a power supply voltage, a dimming signal, a feedback signal, a feedback voltage, and a gate signal when there is no delay circuit under the same condition as FIG. 4.

FIG. 5 shows a power supply voltage, a dimming signal, a feedback signal, a feedback voltage, and a gate signal when there is no delay circuit under the same conditions as FIG. 4.

As shown in FIG. 5, when the dimming signal is short, the gate signal is generated once during the rising period of the feedback voltage, and the feedback signal is not generated so the gate signal is no longer generated.

As shown in FIG. 5, during the three periods of the dimming signal, the power supply voltage is continuously reduced and the power supply voltage is reduced so no current flows to the LED channel.

The delay circuit according to the other exemplary embodiment of the present invention can be realized according to a manner that is different from the circuit shown in FIG. 2. The delay circuit can be realized with a circuit for generating an enable signal during the threshold duty when the dimming signal (Bdim) is less than a predetermined threshold duty.

Figure 6:
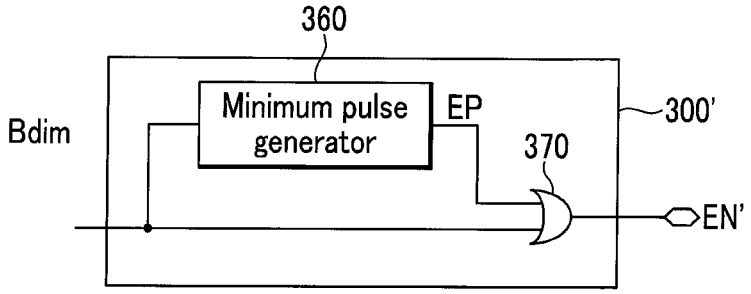
FIG. 6 shows a delay circuit according to another exemplary embodiment of the present invention.

FIG. 6 shows a delay circuit according to another exemplary embodiment of the present invention.

The delay circuit 300' generates an enable signal (EN') having a threshold duty when the duty of the dimming signal (Bdim) is less than the threshold duty.

As shown in FIG. 6, the delay circuit 300' includes a minimum pulse generator 360 and a third logic gate 370.

The minimum pulse generator 360 is synchronized with a duty begin time of the dimming signal (Bdim), and generates a pulse (EP) having the threshold duty (DTH).

The third logical operator 370 generates an enable signal (EN') by an OR operation of the dimming signal (Bdim) and the pulse (EP).

An operation of a delay circuit 300' will now be described with reference to FIG. 7A and FIG. 7B.

Figure 7A:
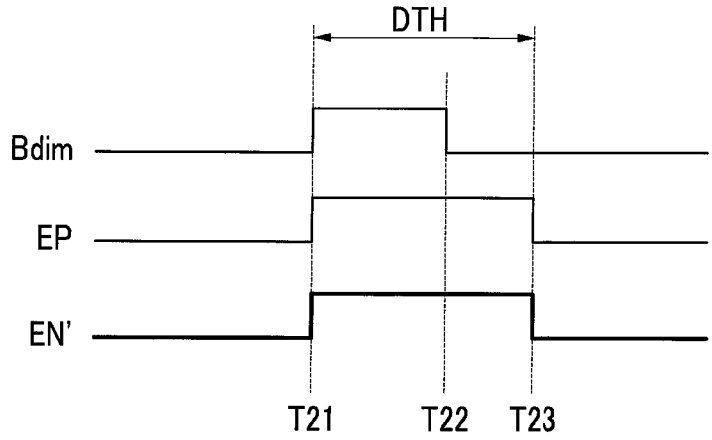
FIG. 7A shows an operation of a delay circuit when a duty of a dimming signal is shorter than a threshold duty.

FIG. 7A shows an operation of a delay circuit when a duty of a dimming signal is shorter than a threshold duty.

Figure 7B:
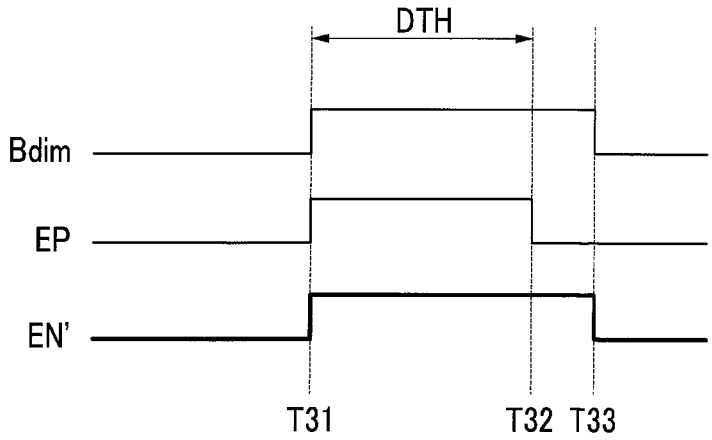
FIG. 7B shows an operation of a delay circuit when a duty of a dimming signal is longer than a threshold duty.

FIG. 7B shows an operation of a delay circuit when a duty of a dimming signal is longer than a threshold duty.

As shown in FIG. 7A, when the dimming signal (Bdim) rises at the time T21, the minimum pulse generator 360 is in synchronization with the rising edge of the dimming signal (Bdim) to generate a pulse (EP) having the high level during a threshold duty (DTH) period.

The third logic gate 370 generates an enable signal (EN') by an OR operation of the dimming signal (Bdim) and the pulse (EP). The pulse (EP) has a duty that is longer than the dimming signal (Bdim) so the enable signal (EN') is generated according to the pulse (EP).

As shown in FIG. 7B, when the dimming signal (Bdim) rises at the time T31, the minimum pulse generator 360 is in synchronization with the rising edge of the dimming signal (Bdim) to generate a pulse (EP) having the high level during the threshold duty (DTH).

The third logic gate 370 generates an enable signal (EN') by an OR operation of the dimming signal (Bdim) and the pulse (EP). The dimming signal (Bdim) has a duty that is longer than the pulse (EP) so the enable signal (EN') is generated according to the dimming signal (Bdim).

The delay circuit 300' according to the other exemplary embodiment of the present invention generates the enable signal (EN') having a threshold duty when the duty of the dimming signal (Bdim) is less than the threshold duty, and the operational period of the error amplifier 540 is extended to the threshold duty. The feedback signal VF1 is generated during at least the threshold duty, and the switching operational period of the power switch (M) is extended.

When the duty is greater than the threshold duty of the dimming signal (Bdim), the rising period of the feedback voltage VF2 is shorter than the entire duty period and the power supply voltage (VLED) is not reduced.

The drawings and the detailed description of the invention given so far are only illustrative, and they are only used to describe the present invention but are not used to limit the meaning or restrict the range of the present invention described in the claims. Therefore, it will be appreciated to those skilled in the art that various modifications may be made and other equivalent embodiments are available. Accordingly, the actual scope of the present invention must be determined by the spirit of the appended claims.

What is claimed is:

1. An LED light emitting device including at least two LED channels comprising:

a power supply for supplying a power supply voltage to first ends of the at least two LED channels;

an error generator for sampling channel voltages of the at least two LED channels to detect a minimum voltage from among the sampled voltages and amplifying a difference between the detected minimum voltage and a predetermined reference voltage to generate an error amplifying signal;

a delay circuit for generating an enable signal by extending a duty of a dimming signal for controlling light emission periods of the at least two LED channels by a predetermined delay period; and a switch control circuit for receiving a feedback signal following the error amplifying signal according to the enable signal, wherein the error generator is operable by the enable signal.

2. The LED light emitting device of claim 1, wherein the error generator includes an error amplifier operable by the enable signal, receiving the reference voltage and the minimum voltage, and amplifying a difference of the reference voltage and the minimum voltage by a predetermined gain to generate the error amplifying signal.

3. The LED light emitting device of claim 2, wherein the error generator further includes a buffer operable by the enable signal and outputting the feedback signal.

4. The LED light emitting device of claim 3, wherein the power supply includes:

a transformer including a primary coil for receiving an input voltage and a secondary coil for generating an output voltage; and a power switch connected to the primary coil and controlling power transmitted to the secondary coil from the primary coil, wherein the switch control circuit controls a switching operation of the power switch according to a result of comparing the feedback signal and a current flowing to the power switch.

5. The LED light emitting device of claim 4, wherein the switch control circuit includes:

a feedback signal transmitter for generating a feedback voltage through a photocoupler for receiving the feedback signal according to the enable signal; and a PWM controller for determining a turn-off time of the power switch by comparing a voltage that corresponds to the feedback voltage and a voltage that corresponds to a current flowing to the power switch, and turning on the power switch according to a clock signal for determining a switching frequency of the power switch.

6. The LED light emitting device of claim 5, wherein the PWM controller stops the switching operation of the power switch by using a result of comparing the feedback voltage and a predetermined burst reference voltage.

7. The LED light emitting device of claim 5, wherein the feedback signal transmitter includes:

a photodiode of the photocoupler including a cathode for receiving the feedback signal;

a control switch connected between the cathode and a ground and performing a switching operation according to the enable signal;

a phototransistor of the photocoupler;

a capacitor connected in parallel to the phototransistor; and a current source for supplying a feedback current to the capacitor and the phototransistor.

8. The LED light emitting device of claim 1, wherein the delay circuit includes:

an SR flip-flop for starting an operation in synchronization with a duty begin time of the dimming signal, and generating a first pulse that ends at a time delayed by the delay period from a duty finish time of the dimming signal; and an inverter for generating the enable signal by inverting the first pulse.

9. The LED light emitting device of claim 8, wherein the delay circuit further includes:

an AND gate for generating a second pulse in synchronization with the time when the dimming signal is finished; and a delay pulse generator for generating a third pulse at a time that is delayed by the delay period from the time when the second pulse is generated, and the SR flip-flop includes:

a first NOR gate for receiving the dimming signal; and a second NOR gate for receiving the third pulse, wherein an output of the second NOR gate is further input to the first NOR gate, an output of the first NOR gate is further input to the second NOR gate, the first pulse is an output of the first NOR gate, and an output of the second NOR gate is further input to the logic gate.

10. An LED light emitting device including at least two LED channels, comprising:

a power supply for supplying a power supply voltage to first ends of the at least two LED channels;

an error generator for sampling channel voltages of the at least two LED channels to detect a minimum voltage from among sampled voltages and amplifying a difference between the detected minimum voltage and a predetermined reference voltage to generate an error amplifying signal; and a delay circuit for generating an enable signal having a predetermined threshold duty by extending a duty of a dimming signal for controlling light emission periods of the at least two LED channels by a predetermined delay period, wherein the delay circuit generates the enable signal with the predetermined threshold duty when the duty of the dimming signal is shorter than the threshold duty and wherein the error generator is operable by the enable signal, wherein the power supply includes a switch control circuit for receiving a feedback signal following the error amplifying signal according to the enable signal.

11. The LED light emitting device of claim 10, wherein the error generator includes an error amplifier operable by the enable signal, receiving the reference voltage and the minimum voltage, and amplifying a difference of the reference voltage and the minimum voltage by a predetermined gain to generate the error amplifying signal.

12. The LED light emitting device of claim 11, wherein the error generator further includes a buffer operable, by the enable signal and outputting the feedback signal.

13. The LED light emitting device of claim 12, wherein the power supply includes:

a transformer including a primary coil for receiving an input voltage and a secondary coil for generating an output voltage; and a power switch connected to the primary coil and controlling power transmitted to the secondary coil from the primary coil, the switch control circuit controls a switching operation of the power switch according to a result of comparing the feedback signal and a current flowing to the power switch.

14. The LED light emitting device of claim 10, wherein the delay circuit includes:

a minimum pulse generator for generating a pulse having the threshold duty in synchronization with a duty begin time of the dimming signal; and a logical operator for performing an AND operation on the dimming signal and the pulse.

15. A method for driving an LED light emitting device including a power switch performing a switching operation to supply a power supply voltage to the LED light emitting device including at least two LED channels, the method comprising:

sampling channel voltages of the at least two LED channels to detect a minimum voltage from among the sampled voltages, and amplifying a difference between the detected minimum voltage and a predetermined reference voltage to generate an error amplifying signal;

generating an enable signal by extending a duty of a dimming signal for controlling light emission periods of the at least two LED channels by a predetermined delay period; and receiving a feedback signal following the error amplifying signal according to the enable signal, wherein the generating of an error amplifying signal is performed while the enable signal is generated.

16. The method of claim 15, wherein the generating of an enable signal includes:

generating a first pulse that starts in synchronization with a duty begin time of the dimming signal, and ends by a time that is delayed by the delay period from a duty end time of the dimming signal; and generating the enable signal by inverting the first pulse.

17. The method of claim 15, further including:

outputting a feedback signal caused by the error amplifying signal according to the enable signal; and controlling a switching operation of the power switch according to a result of comparing the feedback signal and a current flowing to the power switch.

18. A method for driving an LED light emitting device including a power switch performing a switching operation to supply a power supply voltage to the LED light emitting device including at least two LED channels, the method comprising:

sampling channel voltages of the at least two LED channels to detect a minimum voltage from among the sampled voltages, and amplifying a difference between the detected minimum voltage and a predetermined reference voltage to generate an error amplifying signal;

generating an enable signal having a predetermined threshold duty by extending a duty of a dimming signal for controlling light emission periods of the at least two LED channels by a predetermined delay period, wherein the enable signal having the a predetermined threshold duty is generated when the duty of the dimming signal is shorter than the threshold duty, and wherein the generating of the error amplifying signal is performed while the enable signal is generated; and receiving a feedback signal following the error amplifying signal according to the enable signal.

19. The method of claim 18, wherein the generating of an enable signal includes:

generating a pulse having the threshold duty in synchronization with a duty begin time of the dimming signal; and generating the enable signal by performing an AND operation on the dimming signal and the pulse.

20. The method of claim 18, further including:

outputting the feedback signal following the error amplifying signal according to the enable signal; and controlling a switching operation of the power switch according to a result of comparing the feedback signal and a current flowing to the power switch.

* * * * *